US005813845A

United States Patent [19]

Eiermann

[11] Patent Number: 5,813,845

[45] Date of Patent: Sep. 29, 1998

[54] CURVED SILICON-CARBIDE BASED BURNER NOZZLE FOR USE WITH GASEOUS FUEL FLAMES

[75] Inventor: Richard Eiermann, Worcester, Mass.

[73] Assignee: Saint-Gobain/Norton Industrial Ceramics Corporation, Worcester, Mass.

[21] Appl. No.: 763,636

[22] Filed: Dec. 4, 1996

[51] Int. Cl.[6] ..... F23D 14/12; F23D 14/43

[52] U.S. Cl. ..... 431/2; 431/158; 431/353; 431/348

[58] Field of Search ..... 431/2, 350, 353, 431/347, 158, 348, 171; 126/91 A, 91 R

[56] References Cited

U.S. PATENT DOCUMENTS

| | | | |
|---|---|---|---|
| 169,842 | 11/1875 | Ransden | 431/353 |
| 671,574 | 4/1901 | Wing | 431/353 |
| 2,238,715 | 4/1941 | Wells et al. | 431/171 |
| 2,623,579 | 12/1952 | Furkert | 431/347 |
| 2,658,332 | 11/1953 | Nicholson . | |
| 3,222,862 | 12/1965 | Sadownick . | |
| 3,476,324 | 11/1969 | Kohnken . | |
| 3,520,478 | 7/1970 | Shaler . | |
| 3,583,847 | 6/1971 | Petrescu et al. . | |
| 3,622,080 | 11/1971 | Greenwood . | |
| 3,659,787 | 5/1972 | Ito . | |
| 4,029,844 | 6/1977 | Olcott . | |
| 4,312,954 | 1/1982 | Coppola . | |
| 4,759,297 | 7/1988 | McNally et al. . | |
| 4,995,202 | 2/1991 | Gardner et al. . | |
| 5,520,334 | 5/1996 | White . | |
| 5,526,984 | 6/1996 | Foster et al. . | |

FOREIGN PATENT DOCUMENTS 989244 1/1983 Russian Federation .

OTHER PUBLICATIONS

Crystar for High–Temperature Applications, May 1989.
Crystar Burner Insert (No Date).
Norton Refractory Systems, Advancer: A Major Advance in Kiln Furniture (No Date).
Refractory Systems, Technical Bulletin, Advancer Nitride Bonded Silicon Carbide CN–703, Apr. 1995.
Refractory Systems, Technical Bulletin, Crystar Recrystallized Silicon Carbide CS–702, Jun. 1995.
Standard Oil Engineered Materials, Physical Properties of Hexoloy Materials, Apr. 1987.

*Primary Examiner*—Carl D. Price
*Attorney, Agent, or Firm*—Thomas M. DiMauro

[57] ABSTRACT

This invention relates to a torch comprising:

a) a nozzle having a bore extending therethrough, the bore comprising a first end portion, a second end portion, and an arcuate middle portion defining an arcuate tube surface, b) means for providing a flame flowing from the first end portion of the bore towards the second end portion of the bore, so that the flame impinges upon the arcuate tube surface, wherein the arcuate tube surface comprises silicon carbide.

12 Claims, 2 Drawing Sheets

CURVED SILICON-CARBIDE BASED BURNER NOZZLE FOR USE WITH GASEOUS FUEL FLAMES

BACKGROUND OF THE INVENTION

Continuous tunnel kilns which fire products on refractory kiln furniture have typically been fueled by fuel oil. Each burner in the kiln includes a compressed air feed and a fuel oil feed which join at an atomizer and enter a stainless steel nozzle having a 90 degree curve therein. Upon exiting the curved burner nozzle, these fluids produce a combustion flame at an appropriate temperature for firing the desired product. The curve in the nozzle directs the flame away from both the product being fired and the kiln furniture, and so prevents direct impingement of the flame thereon. Moreover, since combustion occurs only on the outside of the nozzle, the flame does not directly impinge upon the inside surface of the stainless steel. The integrity of the nozzle is further insured by the fact that the fuel oil and compressed air feeds provide convective cooling of the nozzle in the 1415° C. kiln.

Recent changes in the prices of fuel oil and natural gas has made natural gas a more attractive energy source, and efforts have been made to convert fuel oil-fired kilns to natural gas. However, typical natural gas-fed kiln systems use burner nozzles having unidirectional bores and are designed to produce a flame which starts inside of the burner nozzle. Since stainless steels typically have melting points of between about 1300° C. and 1450° C., and the typical natural gas flame operates at about 1880° C., a stainless steel curved burner nozzle with a natural gas feed designed to produce a flame inside the nozzle would be expected to melt at the point where the flame impinges upon the curved portion of the nozzle.

Ceramic materials have been used in association with burner nozzles in conventional kilns. For example, ceramic protection tubes have been used as outer protective sleeves for stainless steel burner nozzles in continuous kilns. Typically, the protection tube is installed when the continuous kiln is at room temperature, and is then gradually heated as the temperature of the kiln is gradually ramped up to the desired process temperature. Due to the gradual heating, the tube does not experience thermal shock and the protection tube lasts for years. However, the result is different when the protection tube is replaced during the operation of the same continuous kiln (which runs at a constant design temperature such as 1415° C.). In this situation, the tube experiences a severe thermal shock, and protection tubes made from aluminas or mullite have been found to crack when so used.

U.S. Pat. No. 4,759,297 ("McNally") discloses a burner block including a heat resistant sleeve made of ceramics such as recrystallized silicon carbide which is fit into a conventional burner block cavity whose surrounding structure has experienced cracking due to spatial temperature gradients. However, the type of kiln disclosed in McNally is typically a periodic kiln which has periods of down time in which the sleeve can be installed and then gradually heated up in accordance with the kiln temperature ramp-up schedule. Accordingly, although McNally's use of ceramics provides a solution to the problem caused by spatial temperature gradients in kilns, it does not recognize the thermal shock danger associated with replacing ceramic components in high temperature environments such as the continuous kiln.

Therefore, there is a desire to provide a curved burner nozzle suitable for directing a flame in a gas-fired continuous kiln, wherein the flame is bent by the curved section of the nozzle.

SUMMARY OF THE INVENTION

In accordance with the present invention, there is provided a nozzle having a bore extending therethrough, the bore comprising a first end portion, a second end portion, and an arcuate middle portion defining an arcuate tube surface, wherein the arcuate tube surface comprises silicon carbide.

Also in accordance with the present invention, there is provided a torch comprising:

a) the nozzle described above, and b) means for providing a flame flowing from the first end portion of the bore towards the second end portion of the bore, so that the flame impinges upon the arcuate tube surface.

Also in accordance with the present invention, there is provided a process for directing a gaseous fuel flame, comprising the steps of:

a) providing the nozzle described above, b) introducing a flame into the first end portion of the bore, the flame flowing towards the second end portion of the bore and impinging upon at least a portion of the arcuate tube surface comprising silicon carbide.

DETAILED DESCRIPTION OF THE INVENTION

Figure 1:
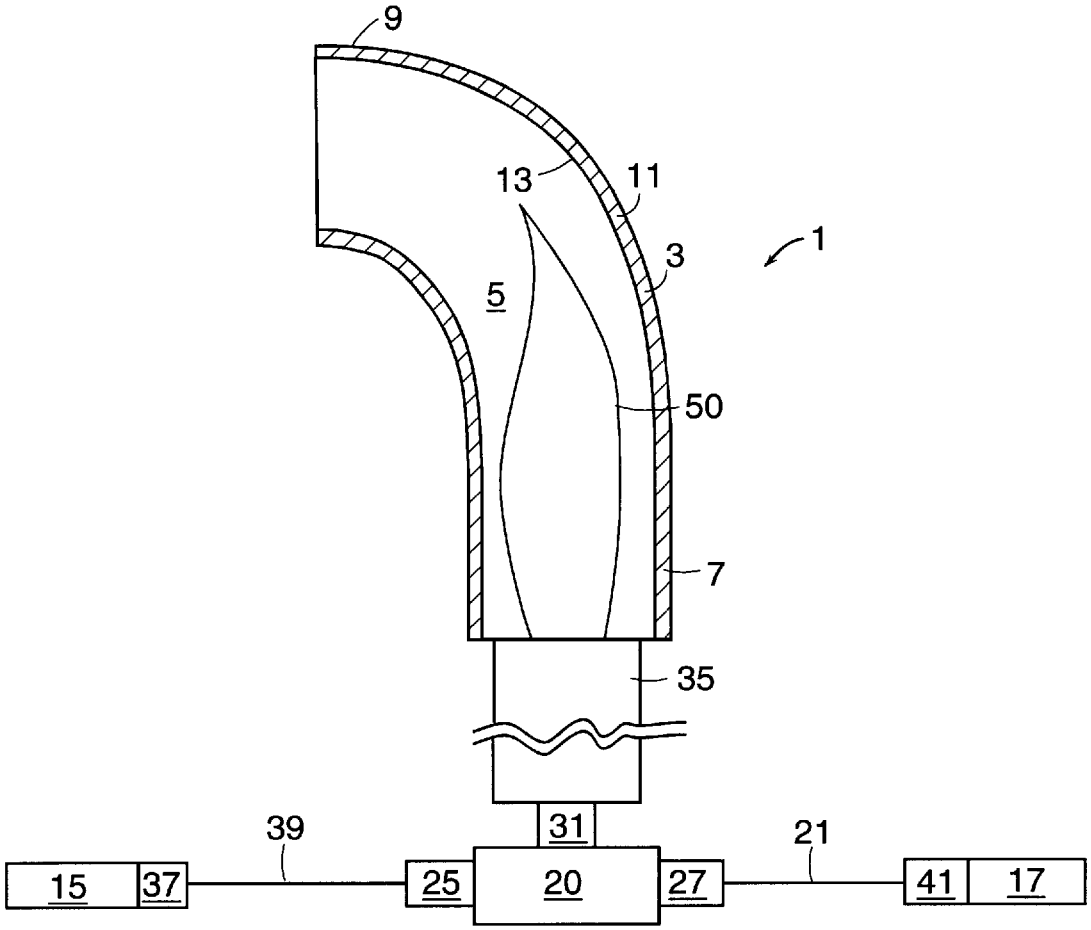
FIG. 1 presents a first embodiment of a torch comprising a cross-section of the curved burner nozzle of the present invention.

It has been found that making the curved burner nozzle from silicon carbide-based ceramics provides sufficient resistance to thermal shock, sagging and oxidation to allow the nozzle to perform well in this application for over 9 months. In particular, a nitride-bonded silicon carbide material available from Saint-Gobain/Norton Industrial Ceramics Corporation, Worcester, Mass. under the designation REFIRED ADVANCER™ performed successfully for over 9 months.

This result is surprising in light of conventional knowledge of these materials in extreme environments. First, it was generally known that ceramics are susceptible to thermal shock. Second, there was concern that impingement of the 1880° C. natural gas flame upon the curve of the burner nozzle would cause sagging because the maximum suggested use temperature of the nitride bonded silicon carbide marketed as REFIRED ADVANCER™ was only about 1450° C.

However, it was surprisingly found that a curved burner nozzle made of the material marketed as REFIRED ADVANCER™ did not crack due to thermal shock for over 9 months of service in a gas fired kiln despite impingement by a 1880° C. flame upon its curved portion. Further, the nozzle displayed minimal oxidation and no detectable sag.

In preferred embodiments, the arcuate tube surface comprises at least 50 weight percent ("wt %") silicon carbide, more preferably at least 63 wt % silicon carbide. Preferably, the arcuate tube surface consists essentially of either recrystallized silicon carbide or bonded silicon carbide. More preferably, the entire burner nozzle is made of the same silicon carbide-based ceramic comprising at least 50 wt % silicon carbide, and most preferably at least 63 wt % silicon carbide. However, other materials such as stainless steel can be used as supporting portions of the burner nozzle when only the arcuate portion of the burner nozzle is a silicon carbide based ceramic.

In some embodiments, a recrystallized silicon carbide is selected as either the arcuate surface or the entire burner nozzle. The low apparent porosity of recrystallized silicon carbide (typically between 15 volume percent ("vol %") and 18 vol %), and its high density (typically between about 2.7 g/cc and about 2.8 g/cc), are believed to provide good oxidation resistance. The high strength of this material at 1450° C. (i.e., a four point flexural strength of at least 138 MPa at 1450° C.) is believed to provide resistance to sag. Its high thermal conductivity (i.e., at least 18 W/m°K, preferably at least 21 W/m°K) and low coefficient of thermal expansion (typically no more than about $5.0\times10^{-6}$/°C. in the temperature range of 22° C. to 1600° C.) are believed to provide the resistance to thermal shock required in this application. In some embodiments, the recrystallized silicon carbide has a bimodal grain size distribution, typically characterized by a 40 wt % to 60 wt % coarse fraction having a grain size of between 10 and 150 $\mu$m, and a 40 wt % to 60 wt % fine fraction having a grain size of between 1 and 3 $\mu$m. It also typically has a four point flexural strength of at least 111 MPa at room temperature. In some embodiments, the recrystallized silicon carbide is made in accordance with U.S. Pat. No. 3,951,587, the specification of which is incorporated by reference. On such recrystallized silicon carbide, marketed under the name of CRYSTAR™ by Saint-Gobain/Norton Industrial Ceramics Corp. of Worcester, Mass., has a published maximum use temperature of 1600° C.

If a bonded silicon carbide is selected, either a nitride bonded silicon carbide or a boron/carbon bonded silicon carbide is typically used. In some embodiments, the nitride bonded silicon carbide comprises between 15 wt % and 35 wt % nitride (typically silicon nitride) and between 65 wt % and 85 wt % silicon carbide. In preferred embodiments, the nitride bonded silicon carbide also comprises 0.1 to 10 wt % iron, and 0.1 to 20 wt % alumina. It also possesses low apparent porosity (typically between essentially 0 vol % for refired embodiments and about 11 vol % for single-fired embodiments); high density (typically between about 2.7 g/cc and about 2.9 g/cc); high strength at 1450° C. (a four point flexural strength of at least 110 MPa at 1450° C.); high thermal conductivity (at least 18 W/m°K, preferably at least 21 W/m°K); and a low thermal expansion coefficient (typically no more than about $4.5\times10^{-6}$/°C. in the temperature range of 22° C. to 1450° C.). The silicon carbide component typically has a grain size distribution of 100 mesh or finer. More preferably, it has a bimodal grain size distribution, typically characterized by a 40 wt % to 60 wt % coarse fraction having a grain size of between 10 and 150 $\mu$m, and a 40 wt % to 60 wt % fine fraction having a grain size of between 1 and 3 $\mu$m. Preferably, it has a four point flexural strength of at least 125 MPa at room temperature. In some embodiments, the nitride bonded silicon carbide is made in accordance with U.S. Pat. No. 4,990,469, the specification of which is incorporated by reference.

In some embodiments, the carbon-boron bonded silicon carbide comprises between about 90 wt % and 99.5 wt % silicon carbide, between 0.15 wt % and 3 wt % boron, and between 0.1 wt % and 1 wt % added carbon. It also possesses low porosity (typically less than 5%; high density (typically between about 3.05 g/cc and about 3.15 g/cc); high strength at 22° C.(a four point flexural strength of at least 460 MPa); high thermal conductivity (at least 50 W/m°K at 400° C.); and a low thermal expansion coefficient (typically no more than about $4.5\times10^{-6}$/°C. in the temperature range of 22° C. to 700° C.).

The silicon carbide component typically has a grain size distribution of 100 mesh or finer. More preferably, it has an average grain size of between 4 $\mu$m and 6 $\mu$m. In some embodiments, the boron/carbon bonded silicon carbide is made in accordance with U.S. Pat. No. 4,312,954, the specification of which is incorporated by reference. On such boron/carbon bonded silicon carbide, marketed under the name HEXOLOY SA™ by Carborundum Corp. of Niagara Falls, N.Y., has a published maximum use temperature of 1650° C.

In some embodiments, at least a portion of the arcuate surface of the nozzle is pre-oxidized to produce a silica skin thereon. This silica skin provides the nozzle with enhanced resistance to oxidation. Typically, the pre-oxidation step is carried out in air at a temperature of between 22° C. and 1415° C. for between about 70 hours to 80 hours, and yields a silica skin of sufficient thickness. The nitride bonded silicon carbide marketed under the name of REFIRED ADVANCER™ possesses a silica skin.

Preferably, the gaseous fuel is either natural gas or propane. Preferably, the oxygen source is air. In some embodiments, the gaseous fuel and the oxygen are mixed in volumetric ratios of between about 10:1 (typically for natural gas) and about 23:1 (typically for propane). The flame resulting from this mixture typically has a temperature of between about 1800° C. and 1925° C., more typically between about 1880° C. and 1925° C.

The angle characterizing the arcuate nature of the nozzle is typically between about 10 degrees and about 120 degrees. More preferably, it is between 45 degrees and 120 degrees. Most, preferably it is about 90 degrees. This angle is defined as that angle produced by the change in direction of the flame as it travels from the first end of the nozzle to the second end of the nozzle.

In accordance with a first aspect of the present invention and with FIG. 1, there is provided a torch 1 comprising:

a) a nozzle 3 having a bore 5 extending therethrough, the bore comprising a first end portion 7, a second end portion 9, and an arcuate middle portion 11 defining an arcuate tube surface 13, wherein the entire nozzle comprises silicon carbide, b) a burner 20 having an oxygen inlet 25, a gaseous fuel inlet 27 and a mixture outlet 31, c) a pipe 35 providing fluid connection between the first end portion 7 of the nozzle 9 and the mixture outlet 31 of the burner 20, d) an oxygen source 15 having an oxygen outlet 37, e) a first conduit 39 providing fluid connection between the oxygen outlet 37 and the oxygen inlet 25, f) a gaseous fuel source 17 having gaseous fuel outlet 41, and g) a second conduit 21 providing fluid connection between the gaseous fuel outlet 41 and the gaseous fuel inlet 27.

In this first aspect, oxygen from the oxygen source 15 and gaseous fuel from the gaseous fuel source 17 are mixed in the burner 20. This mixture travels through pipe 35 at a sufficient temperature to produce a flame 50 starting at the first end 7 of the nozzle 3. Flame 50 impinges upon at least a portion of the arcuate tube surface comprising silicon carbide 13, and then exits the nozzle 3 through the opening at second end portion 9.

Figure 2:
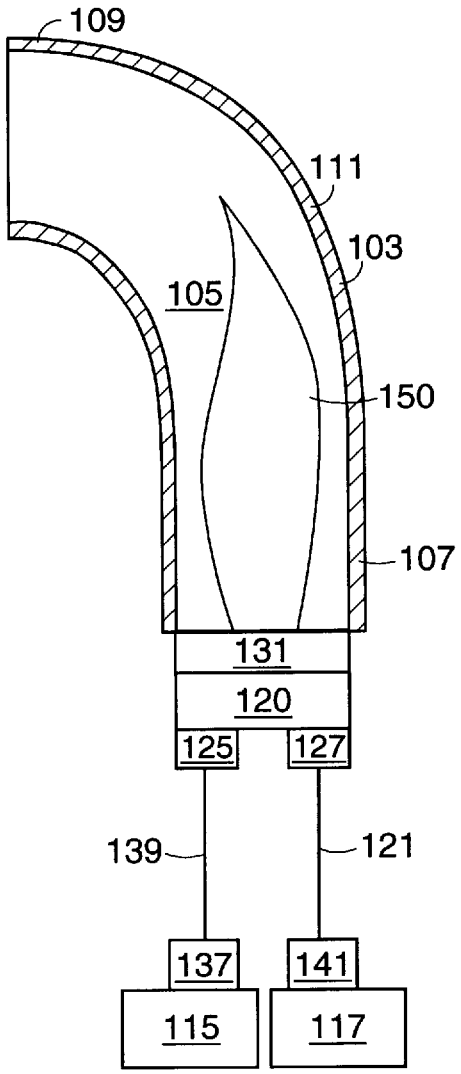
FIG. 2 presents a second embodiment of a torch comprising a cross-section of the curved burner nozzle of the present invention.

In accordance with a second aspect of the present invention and FIG. 2, pipe 35 is removed, the burner is relocated to the edge of nozzle 103, and the gaseous-fuel-oxygen mixture produces a flame 150 almost immediately upon exiting the burner 120. Accordingly, in accordance with the present invention, there is also provided a torch 101 comprising:

a) a nozzle 103 having a bore 105 extending therethrough, the bore comprising a first end portion 107, a second end portion 109, and an arcuate middle portion 111 defining an arcuate tube surface 113, wherein the entire nozzle comprises silicon carbide, b) a burner 120 located near the first end 107 of the nozzle 103, the burner having an oxygen inlet 125 and a gaseous fuel inlet 127, and a flame outlet 131 opening towards the second end 109 of the nozzle 103, c) an oxygen source 115 having an oxygen outlet 137, d) a first conduit 139 providing fluid connection between the oxygen outlet 137 and the oxygen inlet 125, e) a gaseous fuel source 117 having gaseous fuel outlet 141, f) a second conduit 121 providing fluid connection between the gaseous fuel outlet 141 and the gaseous fuel inlet 127.

In this second aspect, oxygen from the oxygen source 115 and gaseous fuel from the gaseous fuel source 117 flow into and mix in the burner 120 at a sufficient temperature to produce a flame 150 which passes through flame outlet 131 and impinges upon at least a portion of the arcuate tube surface 113. Flame 150 then exits the nozzle through the opening at the second end 109 of the nozzle.

The kiln is generally loaded with a sufficient number of burner nozzles to heat the kiln atmosphere up to between about 1400° C. and 1500° C. In some embodiments, kiln furniture made of either nitride bonded-silicon carbide, siliconized silicon carbide or recrystallized silicon carbide and is selected to support products made of nitride bonded-silicon carbide, recrystallized silicon carbide, or alumina. Typically, the kiln furniture passes parallel to the flame direction, and the heat from the flame heats the kiln to a temperature sufficient to fire the products.

When the nozzle of the present invention needs to be replaced, the entire burner system is removed from the kiln while the kiln is in operation, the old nozzle is removed, the new nozzle is installed, and the burner is reintroduced into the high temperature kiln. The entire replacement process takes about 10 minutes.

I claim:

1. A process for directing a gaseous fuel flame, comprising the steps of:

a) providing a nozzle having a bore extending therethrough, the bore comprising a first end portion, a second end portion, and an arcuate middle portion defining an arcuate tube surface, wherein the arcuate tube surface comprises silicon carbide, and b) introducing a flame having a temperature of between about 1800° C. and 1925° C. into the first end portion of the bore, the flame flowing towards the second end portion of the bore and impinging upon at least a portion of the arcuate tube surface comprising silicon carbide at a temperature of between about 1800° C. and 1925° C.

2. The process of claim 1 wherein the flame has a temperature of between about 1880° C. and 1925° C.

3. The process of claim 1 wherein the nozzle is located in an atmosphere of between about 1400° C. and 1500° C.

4. The process of claim 1 wherein the nozzle consists essentially of recrystallized silicon carbide.

5. The process of claim 4 wherein the recrystallized silicon carbide has an apparent porosity of between 15 vol % and 18 vol %, a density of between about 2.7 g/cc and about 2.8 g/cc, a four point flexural strength of at least 138 MPa at 1450° C., a thermal conductivity of at least 18 W/m°K, and a coefficient of thermal expansion of no more than about $4.6\times10^{-6}$/°C. in the temperature range of 22° C. to 1600° C.

6. The process of claim 1 wherein the nozzle consists essentially of bonded silicon carbide.

7. The process of claim 6 wherein the bonded silicon carbide is nitride bonded silicon carbide.

8. The process of claim 7 wherein the nitride bonded silicon carbide has an apparent porosity of between essentially 0 vol % and about 11 vol %, a density of between about 2.7 g/cc and about 2.9 g/cc, a four point flexural strength of at least 110 MPa at 1450° C., a thermal conductivity of at least 18 W/m°K, and a thermal expansion coefficient of no more than about $4.5\times10^{-6}$/°C. in the temperature range of 22° C. to 1450° C.

9. The process of claim 7 wherein the nozzle has a silica skin.

10. The process of claim 6 wherein the bonded silicon carbide comprises boron and carbon.

11. The process of claim 10 wherein the bonded silicon carbide comprising boron and carbon has a porosity of less than 5%, a density of between about 3.05 g/cc and about 3.15 g/cc, a four point flexural strength of at least 460 MPa at 22° C., a thermal conductivity of at least 50 W/m°K at 400° C., and a thermal expansion coefficient of no more than about $4.5\times10^{-6}$/°C. in the temperature range of 22° C. to 700° C.

12. The process of claim 1 wherein the arcuate tube surface having an angle of between about 10 degrees and about 120 degrees.

* * * * *